United States Patent [19]

Miller

[11] Patent Number: 4,886,594

[45] Date of Patent: Dec. 12, 1989

[54] HYDROTREATING CATALYST AND PROCESS

[75] Inventor: Jeffrey T. Miller, Naperville, Ill.

[73] Assignee: Amoco Corporation, Chicago, Ill.

[21] Appl. No.: 90,654

[22] Filed: Aug. 28, 1987

Related U.S. Application Data

[63] Continuation of Ser. No. 543,379, Oct. 19, 1983, abandoned, which is a continuation-in-part of Ser. No. 447,444, Dec. 6, 1982, abandoned.

[51] Int. Cl.[4] ..... C10G 45/00

[52] U.S. Cl. ..... 208/210; 208/216 R; 208/216 PP; 208/251 H; 208/254 H; 502/210

[58] Field of Search ..... 208/210, 216 R, 216 PP, 208/251 H, 254 H, 59; 502/210

[56] References Cited

U.S. PATENT DOCUMENTS

| | | | |
|---|---|---|---|
| 3,123,550 | 3/1964 | Skomoroski | 208/213 X |
| 3,511,890 | 5/1970 | Reusser | 502/211 |
| 3,730,879 | 5/1973 | Christman et al. | 208/210 |
| 3,840,472 | 10/1974 | Colgan | 502/174 |
| 3,928,176 | 12/1975 | Hamner et al. | 208/254 H |
| 4,066,574 | 1/1978 | Tamm | 208/216 PP |
| 4,212,729 | 7/1980 | Hensley, Jr. et al. | 208/210 |
| 4,317,746 | 3/1982 | Richardson | 502/211 |
| 4,419,218 | 12/1983 | Angevine et al. | 208/111 X |
| 4,431,525 | 2/1984 | Hensley, Jr. et al. | 208/216 PP |
| 4,581,129 | 4/1986 | Miller et al. | 208/251 H X |

OTHER PUBLICATIONS

U.S Bulletin of Mines, Bulletin No. 635, (1966), pp. 120–123.

Chomnanti, S. et al., "A Study of an Oil Shale", *Fuel,* vol. 49, (1970), pp. 188–196.

Hawley, Gessner G., *The Condensed Chemical Dictionary,* 9th edition, Van Nostrand Reinhold and Company, N.Y., © 1977, p. 449.

*Primary Examiner*—H. M. S. Sneed

*Assistant Examiner*—George R. Fourson

*Attorney, Agent, or Firm*—Ekkehard Schoettle; William H. Magidson; Ralph C. Medhurst

[57] ABSTRACT

Hydrotreating catalyst composition comprising a hydrogenating component consisting essentially of a metal component in which the metal is selected from Group VIB and a phosphorus component, deposed on the surface of a support comprising a porous refractory inorganic oxide and free of zeolite component exhibits excellent hydrotreating activity and lifetime, particularly in the hydrodenitrogenation of high nitrogen feeds, e.g., whole shale oils or fractions thereof, and in the hydrodesulfurization and hydrodemetallation of high sulfur feeds, e.g., vacuum or atmospheric residual.

15 Claims, 1 Drawing Sheet

FIG. 1
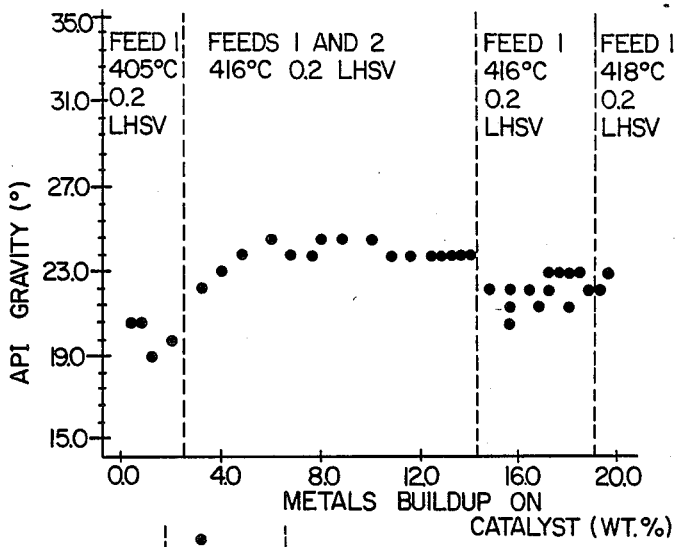
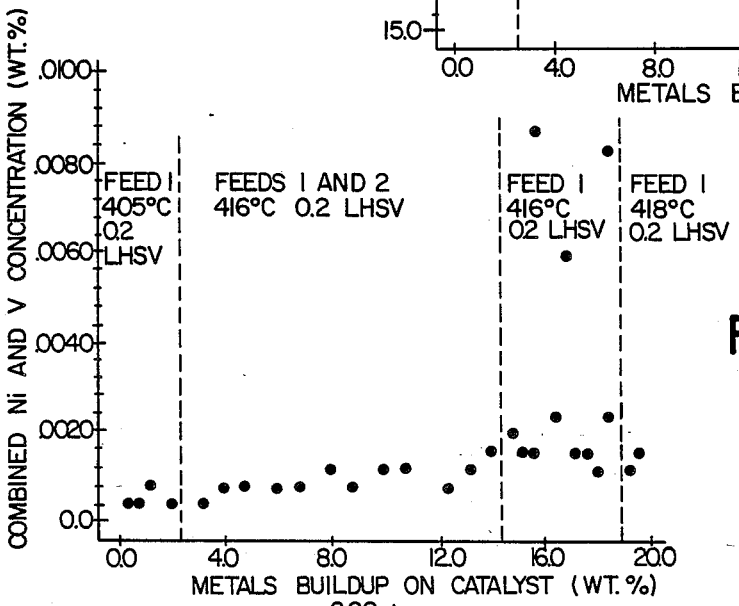
FIG. 2
FIG. 3
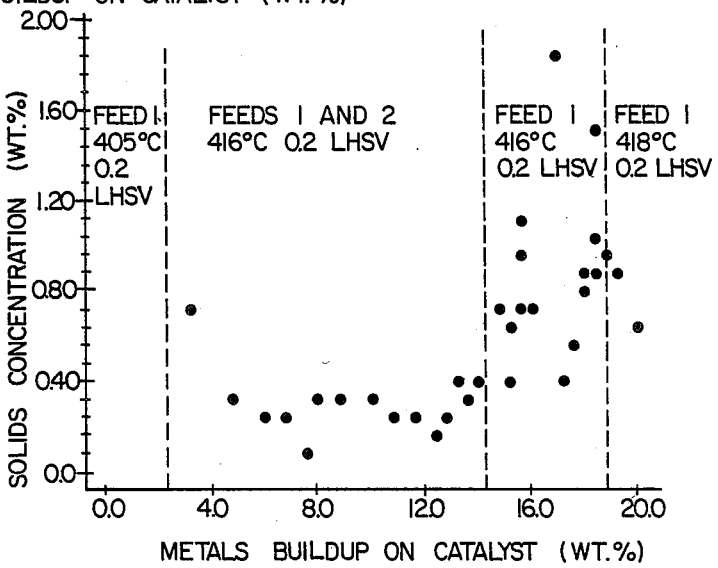

HYDROTREATING CATALYST AND PROCESS

RELATED CASE

This is a continuation, of application Ser. No. 543,379, filed 10/19/83, now abandoned which in turn is a continuation in part of 447,444, filed 12/6/82, now abandoned and which in its entirety is specifically incorporated herein by reference.

BACKGROUND OF THE INVENTION

1. Field of the Invention

This invention relates to hydrotreating catalysts having a desirable combination of activity and high temperature stability and to processes for preparation and use thereof.

2. Description of the Prior Art

Increased concern over availability and security of petroleum crude oil supplies in recent years has focused considerable attention on producing and upgrading lower quality hydrocarbon feeds, such as synthetic crudes and heavy petroleum crude oil fractions. Unfortunately, high concentrations of nitrogen, sulfur, metals and/or high boiling components, for example, asphaltenes, resins, in such lower quality feeds render the same poorly suited for conversion to useful products in conventional petroleum refining operations, such as catalytic cracking and hydrocracking. For example, in catalytic cracking operations, nitrogen and metals tend to poison the cracking catalyst, sulfur leads to increased sulfur oxide emissions during catalyst regeneration, and high boiling components lead to formation of coke on the cracking catalyst which, in turn, can upset the heat balance of the catalytic cracking unit when the catalyst is regenerated. Hydrocracking catalysts also are poisoned by nitrogen and metals, and in addition, sulfur and coke promote deactivation thereof.

In view of such difficulties, lower quality hydrocarbon feeds often are catalytically hydrotreated to obtain materials having greater utility in conventional downstream refining operations. Catalytic hydrotreating involves contacting a feed with hydrogen at elevated temperature and pressure in the presence of catalysts having hydrogenation activity. As a result of such processing, sulfur and nitrogen in the feed are converted largely to hydrogen sulfide and ammonia which are easily removed. Aromatics saturation and, to a lesser extent, cracking of larger molecules often take place to convert high boiling feed components to lower boiling components. Metals content of the feed decreases as a result of deposition of metals on the surface of the hydrotreating catalyst.

Hydrotreating of low quality hydrocarbon feeds often is conducted under conditions more severe than those used in conventional hydrotreating of lighter hydrocarbon feeds in order to achieve suitable levels of nitrogen, sulfur and/or metals removal and/or conversion of high boiling components to lower boiling materials. For example, removal of nitrogen from high nitrogen feeds, such as whole shale oils or fractions thereof, typically requires higher temperatures and pressures and lower space velocities than those used in catalytic hydrotreating of low nitrogen feeds. Similarly, hydrotreating heavy petroleum crude oil fractions, such as vacuum or atmospheric resids and particularly those containing significant quantities of sulfur, metal and/or asphaltenes, usually requires operation under conditions more severe than those employed in hydrotreating lighter feeds.

As can be appreciated, satisfactory operation in processing feeds containing high levels of impurities under severe process conditions places increased demands on the catalyst to be employed as the same must exhibit not only high activity in the presence of impurities and under severe conditions, but also stability and high activity maintenance so that frequent replacement of catalyst is not required. Catalysts containing a Group VIB metal component, such as a molybdenum or tungsten component, promoted by a nickel or cobalt component and supported on a porous refractory inorganic oxide are well known and widely used in conventional hydrotreating processes; however, the same often are somewhat lacking in stability and activity maintenance under severe conditions.

Hensley et al., U.S. Pat. No. 4,297,242 have disclosed catalysts consisting of at least one active original hydrogenation metal selected from Group VIB deposed on a catalytically active support comprising alumina and use thereof with highly desirable results in hydrodesulfurization of heavy hydrocarbon feeds containing sulfur, nitrogen, metals and asphaltenes. Hensley et al. also disclose that such catalysts exhibit lower deactivation and improved lifetime, even under severe operating conditions, as compared to catalysts containing a Group VIB metal component promoted by a cobalt component.

Hensley et al., U.S. Pat. No. 4,212,729, which in its entirety is specifically incorporated herein by reference, disclose a two-stage catalytic process for hydrodemetallation and hydrodesulfurization of heavy hydrocarbon streams containing asphaltenes and a substantial amount of metals. The first stage of the process comprises contacting the feedstock in a first reaction zone with hydrogen and a demetallation catalyst comprising hydrogenation metal selected from Group VIB and/or Group VIII deposed on a relatively large-pore, high surface area inorganic oxide support. The second stage of the process comprises contacting the effluent from the first reaction zone with a catalyst consisting essentially of hydrogenation metal selected from Group VIB deposed on a relatively small pore, catalytically active support comprising alumina. The second stage catalyst has a surface area within the range of about 150 $m^2/gm$ to about 300 $m^2/gm$, a pore volume within the range of about 0.4 cc/gm to about 0.9 cc/gm, an average pore diameter within the range of about 90 Å to about 160 Å, and a majority of its pore volume in pore diameters within the range of about 80 Å to about 130 Å. More particularly, the pore volume distribution is such that less than 40% of its pore volume is in pores having diameters within the range of about 50 Å to about 80 Å, about 45% to about 90% of its pore volume is in pores having diameters within the range of about 80 Å to about 130 Å, and less than about 15% of its pore volume is in pores having diameters larger than 130 Å. More preferably, the catalyst disclosed has a pore volume distribution summarized as follows:

| Pore Diameter, Å | % of Pore Volume |
|---|---|
| 50–80 | <40 |
| 80–100 | 15–65 |
| 100–130 | 10–50 |
| >130 | <15 |

In terms of the surface area, the pores of the disclosed catalyst having diameters within the range of about 80 Å to about 130 Å preferably contain about 90 to about 180 $m^2/gm$, and more preferably contain about 120 to about 180 $m^2/gm$, of surface area.

It has also been found that addition of a chromium component to catalysts comprising a Group VIB metal component alone or promoted by a Group VIII metal component gives highly desirable results in a wide range of applications including high severity hydrotreating applications. Such catalysts and processes for use thereof are disclosed in Quick et al., U.S. Pat. No. 4,181,602; Quick et al., U.S. Pat. No. 4,188,284; Quick et al., U.S. Pat. No. 4,191,635; Hensley et al., U.S. Pat. No. 4,224,144; Hensley et al., U.S. Pat. No. 4,278,566; and Hensley et al., U.S. Pat. No. 4,306,965.

It has long been known that preparation of hydrotreating catalysts containing Group VIB and Group VIII metal components supported on a porous refractory inorganic oxide can be improved through the use of phosphoric acid impregnating solutions of precursors to the Group VIB and Group VIII metal components or the use of phosphoric acid as an impregnation aid for the metal precursors. Thus, Pessimisis, U.S. Pat. No. 3,232,887 discloses stabilization of Group VI and Group VIII metal-containing solutions through the use of water-soluble acids. According to the patentee, in column 3, lines 6–11, "in its broadest aspect the invention comprises the preparation of stabilized aqueous solutions which comprise an aqueous solvent having dissolved therein catalytically active compounds containing at least one element from Group VI of the periodic table and one element from Group VIII." Inorganic oxyacids of phosphorus are included among the disclosed stabilizers, and the examples of Pessimisis illustrate preparation of various cobalt-molybdenum, nickel-molybdenum, and nickel-tungsten catalysts using phosphorus and other acids as stabilizers. Hydrodesulfurization results with certain of the cobalt-molybdenum catalysts are presented, and the patentee suggests that the use of the stabilized solutions may lead to improved hydrodesulfurization activity in some instances.

Similarly, Colgan et al., U.S. Pat. No. 3,287,280 discloses the use of phosphoric acid as an impregnation aid in preparation of nickel-molybdenum catalysts and that such use can result in catalysts having improved hydrodesulfurization activity.

Kerns et al., U.S. Pat. No. 3,446,730 disclose hydrodenitrogenation catalysts comprising at least one of a nickel component and a Group VI metal component, supported on a specific alumina, such catalysts being promoted with 0.1 to 2.0 wt. % of a promoter selected from compounds of phosphorus, silicon and barium. However, at column 3, lines 26–38, the patentees make the following remarks with respect to promotion of hydrogenating metals on the specific alumina disclosed, as follows:

> "The nature of the hydrogenation component of the composite catalysts disclosed herein is very important, as we have found that not every hydrogenation component, when composited with the herein disclosed aluminas, is susceptible to promotion as disclosed herein. For example, cobalt-containing catalysts prepared from the special aluminas disclosed herein are unsuitable for purposes of this invention, not-withstanding that cobalt is often a component of conventional denitrogenation catalysts. In fact, our experiments indicate that the denitrogenative activity of catalysts comprising cobalt and the special activated aluminas disclosed herein are actually lessened by the addition thereto of phosphorus, silicon or barium."

Hilfman, U.S. Pat. No. 3,617,528 discloses hydrotreating catalysts comprising coextruded nickel and phosphorus components and an alumina-containing support. The catalysts also may contain a Group VIB metal component.

Mickelson et al., U.S. Pat. No. 3,706,693 and Hass et al., U.S. Pat. No. 3,725,243 disclose hydrotreating catalysts prepared by forming an intimate admixture of an amorphous, foraminous, refractory oxide containing a substantial proportion of alumina with at least one crystalline, ion-exchangeable aluminosilicate containing less than about 5 wt. % alkali metal oxides, and contacting the result with an aqueous acidic solution of at least one Group VIII metal compound, at least one Group VI metal compound and at least one phosphorus acid at a pH below about 3 under conditions effective to deposit catalytic amounts of the metals on the refractory oxide and react at least a portion of the aluminosilicate with the aqueous acidic medium. According to the patentees, the disclosed catalysts are more tolerant of nitrogen than catalysts prepared without an aluminosilicate component. Further, Examples 10–13 of both patents illustrate catalysts exhibiting improved hydrodenitrogenation activity as compared to catalysts prepared without an aluminosilicate component. Reported hydrodesulfurization activity is slightly worse.

Mickelson, U.S. Pat. Nos. 3,749,663; 3,749,664; 3,755,150 and 3,755,196 disclose catalysts comprising molybdenum, at least one Group VIII metal component and phosphorus deposed on a refractory inorganic oxide support. The '664 patent is directed specifically to the use of such catalysts for hydrodenitrogenation.

Colgan et al., U.S. Pat. No. 3,840,472 disclose catalysts prepared by impregnation of an alumina support with stabilized solutions of molybdic oxide and certain cobalt or nickel salts dissolved in aqueous phosphoric acid although the patentees suggest that the presence of certain amounts of a phosphorus component in the ultimate catalyst may harm performance, stating the following at column 2, lines 23–28:

> "In addition, however, phosphoric acid must not be present in the impregnating solution in an amount which upon subsequent calcination of the catalyst material will adversely affect the activity and strength of the catalyst in use and upon repeated regenerations to any substantial extent."

Simpson, U.S. Pat. No. 4,255,282 discloses hydrotreating catalysts comprising molybdenum, nickel, and phosphorus components and a gamma-alumina support, such catalysts being prepared by a method that involves a precalcination of the gamma-alumina at a temperature greater than 746° C. With respect to the phosphorus component, Simpson teaches that the same often has been included in hydrotreating catalysts to increase catalyst acidity and thereby improve activity.

Ripperger and Saum, *Chemistry and Uses of Molybdenum, Proceedings of the Second International Conference*, pages 175–179 (1976), report that addition of phosphoric acid to a catalyst consisting of nickel and molybdenum supported on alumina resulted in increased hydrodenitrogenation activity but that effective promoters could not be found for catalysts consisting of cobalt and molybdenum on alumina.

While the patents and publication discussed above disclose that the use of phosphoric acid in the preparation of hydrotreating catalysts containing Group VIB and Group VIII metal components is beneficial to the preparations, reported effects on catalytic activity and performance vary significantly. For example, the general statement in the aforesaid Simpson patent regarding use of a phosphorus component to increase acidity and thereby improve activity is contrary to the teaching of Colgan, U.S. Pat. No. 3,840,472 that use of phosphoric acid in improper amounts can adversely affect catalyst activity and strength. More specifically, while the aforesaid Pessimisis patent and Colgan et al., U.S. Pat. No. 3,287,280 attribute to use of phosphoric acid in catalyst preparation, or to phosphoric acid residue content in finished catalysts, promotional effects in respect of hydrodesulfurization activity of cobalt-molybdenum and nickel-molybdenum catalysts, and while certain of the aforesaid Mickelson patents illustrate a similar influence on hydrodenitrogenation activity of Group VI and Group VIII metals-containing catalysts, the aforesaid Ripperger and Saum article teach that phosphoric acid use leads to improved hydrodenitrogenation activity for nickel-molybdenum catalysts but not for cobalt-molybdenum catalysts. Further, the aforesaid Kerns et al. patent teaches that hydrodenitrogenation activity of cobalt-containing catalysts in general, and nickel-molybdenum-cobalt catalysts in particular, decreases when the specific alumina support disclosed therein is employed and when a phosphorus promoter is used.

Notwithstanding the diverse teachings of the aforesaid patents and publication in respect of stabilization and promotion of hydrotreating catalysts, there is a continuing need for development of improved catalysts.

OBJECTS OF THE INVENTION

It is therefore a general object of this invention to provide an improved hydrotreating catalyst as well as hydrotreating processes which employ such catalyst.

A further object of the invention is to provide a catalyst of improved stability and lifetime under high severity hydrotreating conditions.

Another object of the invention is to provide for such improvements by simple and inexpensive methods for catalyst preparation and without the need for expensive reactants or complicated preparative techniques.

A more specific object of the invention is to provide a catalyst of improved activity and stability for hydrotreating high nitrogen hydrocarbon feeds under severe conditions as well as methods for the use of such catalyst.

It is another object of this invention to provide a catalyst of improved activity and stability for hydrotreating high sulfur hydrocarbon feeds under severe conditions, and also to provide methods for the use of such catalysts.

It is a further object of this invention to provide a catalyst of improved activity and stability for hydrotreating high metal hydrocarbon feeds under severe conditions and to provide methods for the use of such catalyst.

It is a related object of this invention to provide an improved process for the hydrodemetallation and hydrodesulfurization of heavy hydrocarbon streams containing metals and sulfur and to provide an improved catalyst for use in such process.

Other objects of the invention will be apparent to persons skilled in the art from the following description and appended claims, and upon reference to the accompanying drawings.

SUMMARY OF THE INVENTION

These objects are achieved by the catalytic composition of the present invention comprising a hydrogenating component supported on the surface of a porous refractory inorganic oxide support, wherein the hydrogenating component consists essentially of (1) a metal component in which the metal is selected from Group VIB of the Periodic Table and (2) a phosphorus component and wherein the support is free of a zeolite component. The present invention is also a method for hydrotreating a hydrocarbon feed in the presence of such catalyst.

In a preferred embodiment, the aforesaid catalyst has a pore volume within the range of about 0.4 cc/gm to about 0.9 cc/gm, a surface area within the range of about 130 $m^2$/gm to about 300 $m^2$/gm, an average pore diameter within the range of about 90 Å to about 160 Å, and a pore volume distribution such that less than 40% of its pore volume is in pores having diameters within the range of about 50 Å to about 80 Å, about 45% to about 90% of its pore volume is in pores having diameters within the range of about 80 Å to about 130 Å, and less than about 15% of its pore volume is in pores having diameters larger than 130 Å. In this embodiment, it is also preferred that the catalysts comprises from about 8 wt. % to about 22 wt. % product of the Group VIB metal component, calculated as the metal oxide, and from about 0.5 wt. % to about 3 wt. % of the phosphorus component, calculated as elemental phosphorus and based on the weight of the catalyst.

In another preferred embodiment, the aforesaid catalyst has a pore volume within the range of from about 0.3 cc/gm to about 1.2 cc/gm, a surface area within the range of from about 100 $m^2$/gm to about 350 $m^2$/gm, and an average pore diameter within the range of from about 70 Å to about 120 Å. In this embodiment, it is also preferred that the catalyst comprises from about 15 wt. % to about 22 wt. % of the Group VIB metal component, calculated as the metal oxide and based on the weight of the catalyst, and from about 0.5 wt. % to about 3 wt. % of the phosphorus component, calculated as elemental phosphorus and based on the weight of the catalyst.

In a further preferred embodiment, the aforesaid catalyst has a pore volume within the range of from about 0.7 cc/gm to about 1.7 cc/gm, a surface area within the range of from about 100 $m^2$/gm to about 400 $m^2$/gm, and an average pore diameter within the range of from about 125 Å to about 350 Å. In this embodiment, the hydrogenation component consists essentially of a Group VIB metal component, a phosphorus component, and optionally a Group VIII metal component. The Group VIB metal component is at a concentration within the range of from about 1 wt. % to about 30 wt. % calculated as the metal oxide and based on the weight of the catalyst. The phosphorus component is present at a concentration of from about 0.5 wt. % to about 3 wt. %, calculated as elemental phosphorus and based on the weight of the catalyst. The Group VIII metal component is present at a concentration up to about 15 wt. %, calculated as the metal oxide and based on the weight of the catalyst.

BRIEF DESCRIPTION OF THE DRAWINGS

For a more complete understanding of this invention, reference should now be made to the accompanying drawings. In the drawings:

FIG. 1 contains a plot of the API gravities of the liquid products from a two-stage hydrodemetallation and hydrodesulfurization of a heavy hydrocarbon stream, in which a catalyst of the present invention was employed in the hydrodesulfurization stage;

FIG. 2 contains a plot of the concentrations of metals in the liquid products from a two-stage hydrodemetallation and hydrodesulfurization of a heavy hydrocarbon stream, in which a catalyst of the present invention was employed in the hydrodesulfurization stage; and FIG. 3 contains a plot of the solids concentrations of the liquid products from a two-stage hydrodemetallation and hydrodesulfurization of a heavy hydrocarbon stream, in which a catalyst of the present invention was employed in the hydrodesulfurization stage.

DETAILED DESCRIPTION OF THE INVENTION INCLUDING PREFERRED EMBODIMENTS

Stability and activity maintenance of the catalysts of the present invention, particularly under high severity hydrotreating conditions and in the presence of high levels of impurities, are comparable or superior to those of high stability catalysts, such as those of Hensley et al. '242, in which the original active hydrogenation metal is selected from Group VIB, as well as those of Quick et al. '602, '284 and '635 and Hensley et al. '144, '566 and '965, in which a stabilizing chromium component is incorporated into hydrogenating components comprising another metal of Group VIB or combinations thereof with a metal of Group VIII. Further, the catalysts of the present invention exhibit activities comparable or superior to those of conventional catalysts wherein the hydrogenating component contains a Group VIB metal component alone or promoted by a Group VIII metal component. As such, the invented catalysts are particularly well suited for hydrotreating feeds containing nitrogen, sulfur, metals and/or high boiling components under severe hydrotreating conditions.

Such a desirable combination of activity, stability and activity maintenance could not have been predicted from the patents and publication discussed hereinabove. To the extent, if any, the high stability of the invented catalysts might be viewed as paralleling the stability of the catalysts of Hensley et al. '242, which contain a metal from Group VIB as the sole active original hydrogenating metal, the invented catalyst's maintenance of such stability in the presence of an activity-promoting phosphorus component was not expected. Further, to the extent the aforesaid patents and publication relating to the use of phosphoric acid in the preparation of hydrotreating catalysts may be viewed as suggestive of some activity-promoting effect exerted by the phosphoric acid or residues thereof, reported effects vary significantly depending on the particular metals contained in a hydrogenating component, and in any event, there is no suggestion of a promotional effect on activity of the Group VIB metals alone.

Briefly, the improved hydrotreating catalysts of this invention comprise a hydrogenating component consisting essentially of (1) a metal component in which the metal is selected from Group VIB and (2) a phosphorus component, such hydrogenating component being deposed on the surface of a support component comprising a porous refractory inorganic oxide and free of a zeolite component. Preferred catalysts are those in which the phosphorus component is a phosphoric acid residue, the same most preferably being prepared by impregnation of a support component comprising a porous refractory inorganic oxide with an impregnating solution containing phosphoric acid and one or more precursors to the aforesaid metal component. Such catalysts are used in hydrotreating hydrocarbon feeds containing nitrogen, sulfur, metals and/or high boiling components wherein the feed is contacted with hydrogen under hydrotreating conditions, particularly severe hydrotreating conditions, in the presence of the catalyst.

In greater detail, the hydrogenating component of the invented catalyst comprises (1) a metal component in which the metal is selected from Group VIB and (2) a phosphorus component. The Group VIB metal can be molybdenum, chromium, tungsten or a binary or ternary combination thereof. The Group VIB metal is present in the metal component in elemental form, as an oxide or sulfide, as an oxygenated phosphorus species or as a combination thereof. Preferably, the Group VIB metal of the metal component is molybdenum alone or in combination with chromium or tungsten, because molybdenum exhibits superior hydrogenation activity when promoted by a phosphorus component. Most preferably, a molybdenum component is the sole Group VIB metal component in the metal component of the hydrogenation component. The hydrogenating component also contains a phosphorus component which is present in a form effective to promote the activity of the Group VIB metal component. A preferred phosphorus component is a phosphoric acid residue remaining in the hydrogenation component as a result of simultaneous or sequential impregnation of support component with a solution or solutions consisting essentially of a precursor to the metal component and phosphoric acid in a suitable solvent, for example, water. While not wishing to be bound by theory, it is believed that phosphoric acid residues present in the hydrogenating component are present in the form of one or more oxides, a phosphate anion, compounds of the Group VIB metal or metals of the hydrogenating component and/or polymeric species containing recurring phosphorus-oxygen units and/or phosphorus-oxygen-Group VIB metal groups.

Presently preferred catalysts according to the present invention comprise about 1 to about 50 weight percent hydrogenating component and about 50 to about 99 weight percent support. In greater detail, the Group VIB metal content preferably ranges from about 1 to about 30 weight percent, calculated as the metal oxide, that is, $MoO_3$, $WO_3$, $Cr_2O_3$. The phosphorus component is present in an amount effective to promote the activity, the amount preferably ranging from about 0.1 to about 5 weight percent, calculated as elemental phosphorus, in order to promote the activity without adversely affecting the strength and other important catalyst physical properties. It is to be understood that the weight percentages set forth herein are based upon total catalyst weight after calcination.

The support on which the aforesaid hydrogenating component is deposed comprises at least one porous refractory inorganic oxide, specific examples of which include silica, alumina, silica-alumina, zirconia, titania, magnesia, boria and the like. Of course, combinations of metal oxides also are contemplated. Modified porous refractory inorganic oxides, such as fluorided aluminas and chlorided silica-alumina also are contemplated. Supports containing minor amounts of one or more oxides of phosphorus, for example, up to about 2 wt. %, calculated as phosphorus, in combination with one or more of the aforesaid porous refractory inorganic oxides also can be employed although the same are not preferred, because the presence of phosphorus oxide in the support can be detrimental to promotion of the hydrogenating metal component with phosphorus. Furthermore, the presence of a zeolite component in the support of the catalyst of this invention changes the essential character of the catalyst and hence is not contemplated for the catalyst of this invention.

As indicated hereinabove, a wide range of supports is suitable for impregnation according to this invention. The support preferably is calcined prior to any impregnation in which phosphorus component precursor is to be present as hydroxyl groups of the support may react with the precursor and thereby hinder incorporation of sufficient phosphorus component into the hydrogenating component. The support can be used in any suitable form, for example, as extrudates, spheres or powder. From the standpoint of attaining desirable hydrotreating performance, presently preferred supports are aluminas and silica-aluminas containing up to about 50 wt. % of silica. More preferably, the support is an alumina or a silica-alumina containing up to about 50 wt. % of silica. In addition, it is preferred that the finished catalysts have a BET surface area of at least about 100 $m^2$/gm, a pore volume of about 0.3 to about 1.7 cc/gm, both as determined by nitrogen desorption, and an average pore diameter within the range of from about 70 Å to about 350 Å.

When the catalyst of this invention is used in a hydrotreating operation in which removal of sulfur is a major concern, for example, with a feed comprising a vacuum or atmospheric resid, it is highly preferred that the catalyst has a pore volume within the range of about 0.4 cc/gm to about 0.9 cc/gm, a surface area within the range of about 130 $m^2$/gm to about 300 $m^2$/gm, an average pore diameter within the range of about 90 Å to about 160 Å, and a pore volume distribution such that less than 40% of its pore volume is in pores having diameters within the range of about 50 Å to about 80 Å, about 45% to about 90% of its pore volume is in pores having diameters within the range of about 80 Å to about 130 Å, and less than about 15% of its pore volume is in pores having diameters larger than 130 Å. More preferably, the catalyst of this invention has a pore volume distribution summarized as follows:

| Pore Diameter, Å | % of Pore Volume |
|---|---|
| 50–80 | <40 |
| 80–100 | 15–65 |
| 100–130 | 10–50 |
| >130 | <15 |

Most preferably, the catalyst of this invention has a pore volume within the range of about 0.5 cc/gm to about 0.7 cc/gm, a surface area within the range of about 140 $m^2$/gm to about 250 $m^2$/gm, an average pore diameter within the range of about 110 Å to about 140 Å, and a pore volume distribution summarized as follows:

| Pore Diameter, Å | % of Pore Volume |
|---|---|
| 50–80 | <40 |
| 80–100 | 25–65 |
| 100–130 | 10–50 |
| >130 | <5 |

In terms of the surface area, when the catalyst of this invention is used as a hydrodesulfurization catalyst with a feed comprising a vacuum or atmospheric resid, the catalyst pores having diameters within the range of about 80 Å to about 130 Å preferably contain about 90 $m^2$/gm to about 180 $m^2$/gm, and more preferably contain about 120 $m^2$/gm to about 180 $m^2$/gm, of surface area in order to attain maximum desulfurization activity.

When used as a desulfurization catalyst, the catalyst of the present invention preferably comprises from about 8 wt. % to about 22 wt. % of the Group VIB metal component, calculated as the metal oxide and based on the weight of the catalyst, and from about 0.5 wt. % to about 3 wt. % of the phosphorus component, calculated as elemental phosphorus and based on the weight of the catalyst.

When the catalyst of this invention is used in a hydrotreating operation in which removal of nitrogen is a major concern, for example, with a feed comprising a whole shale oil or shole oil fraction, it is highly preferred that the catalyst has a pore volume within the range of about 0.3 cc/gm to about 1.2 cc/gm, a surface area within the range of from about 100 $m^2$/gm to about 350 $m^2$/gm and an average pore diameter within the range of from about 70 Å to about 120 Å. In such case, it is also preferred that the catalyst comprise from about 15 wt. % to about 22 wt. % of the Group VIB metal component, calculated as the metal oxide and based on the weight of the catalyst, and from about 0.5 wt. % to about 3 wt. % of the phosphorus component, calculated as elemental phosphorus and based on the weight of the catalyst.

When the catalyst of this invention is used in a hydrotreating operation in which removal of metals is a major concern, for example, with a feed comprising a high metals resid, it is highly preferred that the catalyst has a pore volume within the range of from about 0.7 cc/gm and 1.7 cc/gm, a surface area within the range of from about 100 $m^2$/gm to about 400 $m^2$/gm, an average pore diameter within the range of from about 125 Å to about 350 Å, a Group VIB metal component concentration from about 1 wt. % to about 30 wt. %, preferably to about 20 wt. %, calculated as the metal oxide and based on the weight of the catalyst, a Group VIII metal component concentration of up to about 15 wt. %, preferably from about 0.5 wt. % to about 12 wt. %, calculated as the metal oxide and based on the weight of the catalyst, and a phosphorus component concentration of from about 0.5 wt. % to about 3 wt. %, calculated as elemental phosphorus and based on the weight of the catalyst. In this context, the pore size or pore volume distribution of the demetallation could be bimodal so long as the above pore volume, surface area and average pore diameter requirements are met.

The invented catalysts are prepared by impregnation of a support comprising at least one porous refractory inorganic oxide with a solution or solutions consisting essentially of precursors to the metal and phosphorus components of the final catalyst in a suitable solvent and calcination of impregnated support. Most preferably, simultaneous impregnation of a support with phosphorus and metal component precursors, followed by calcination of the impregnated support, is conducted in order to maximize the promotional effect of the phosphorus component of the final catalyst. However, sequential impregnation with phosphorus and metal component precursors also gives good results. A preferred sequential impregnation involves impregnation of support with phosphorus component precursor followed by calcination, followed by impregnation with metal component precursor, followed by final calcination.

The mechanics of impregnating a support are well known to persons skilled in the art. A technique preferred for the sake of simplicity involves forming a solution or solutions of appropriate compounds in a suitable solvent and contacting a support with an amount or amounts of solution or solutions sufficient to fill the pores of the support. Useful precursors to the metal component of the invented catalysts also are well known to persons skilled in the art. Specific examples include ammonium chromate, ammonium dichromate, chromium (III) nitrate, chromium acetate, ammonium heptamolybdate, ammonium paramolybdate, molybdic anhydride, phosphomolybdic acid and ammonium tungstate.

Phosphorus component precursors useful in preparation of the invented catalysts include phosphoric acid, phosphorous acid, hypophosphorous acid and pyrophosphoric acid. Esters of such acids also can be used although they are not preferred. Phosphorus oxides, such as $P_2O_5$ and $P_4O_6$, also can be used. Salts of the aforesaid acids and esters also are contemplated. Specific examples of these include ammonium phosphate, diammonium hydrogen phosphate and ammonium dihydrogen phosphate. As the preferred catalysts according to this invention are those in which a phosphoric acid residue is present, phosphoric acid is the preferred phosphorus component precursor. Most preferably, dilute or concentrated aqueous phosphoric acid is used as an impregnating solvent for the Group VIB metal component precursor. Other phosphorus component precursors can be employed in the form of a solution in a suitable solvent, such as water or alcohol, or the same can simply be dissolved in a solution or solutions containing one or more Group VIB metal component precursors. Phosphorus compound concentrations vary depending on solubility, amount of phosphorus component desired in the ultimate catalyst and amount of solution that can be accommodated by the particular support to be used as can be appreciated by persons skilled in the art.

It of course must be recognized in the discussion of impregnation techniques hereinabove, that when the catalyst of this invention is used as a hydrodemetallation catalyst, a Group VIII metal component precursor can be used in place of, or in addition to, the Group VIB metal component precursor in the impregnation process.

Following impregnation of support with one or more precursors to the hydrogenating component, the impregnated support is calcined. Calcination preferably is conducted at temperatures of at least about 425° C. and more preferably at least about 535° C. for a period of at least about ½ hour. The calcination is conducted in the presence of a gas containing molecular oxygen, air being preferred from the standpoint of convenience and cost. While not required, it is desirable to dry the impregnated support at a temperature high enough to drive off excess solvent from the impregnation step prior to calcination. When water is used as the solvent in impregnation, preferred temperatures are at least about 120° C. Drying times of at least about ½ hour are preferred.

Prior to hydrotreating use of the invented catalysts, if desired, sulfiding can be conducted to sulfide and partially reduce the metal or metals of the hydrogenating component. A sulfiding treatment that is preferred from the standpoint of convenience comprises heating the catalyst to from about 120° C. to about 180° C. and contacting the catalyst with a flowing gaseous mixture of hydrogen sulfide and hydrogen under pressure for from about ½ to about 2 hours, raising the temperature to from about 175° C. to about 235° C. with continued flow of the gaseous mixture for an additional ½ to about 2 hours, raising the temperature to from about 340° C. to about 400° C., and contacting with additional hydrogen-hydrogen sulfide gas mixture for an additional period of time, preferably from about ½ to about 2 hours. The gas should be employed in an amount effective to provide at least about 110 percent of the stoichiometric amount of hydrogen sulfide needed to sulfide the metal or metals of the hydrogenating component. The concentration of hydrogen sulfide in the gaseous mixture is not critical.

While the above-described sulfiding treatment technique is preferred from the standpoint of convenience, other methods can be employed. For example, the catalyst can be contacted with carbon disulfide or a hydrocarbon oil containing sulfur can be passed over the catalyst for a time sufficient to convert the hydrogenating component to sulfide form.

Preferably, sulfiding treatment is conducted while the catalyst is disposed in a hydrotreating reaction zone because on conclusion thereof, the flow of hydrogen sulfide or other source of sulfide can be discontinued and hydrogen partial pressure and temperature adjusted to operating levels. Once operating conditions are achieved, hydrocarbon feed is simply introduced into the reaction zone.

Hydrotreating according to the present invention can be conducted in either fixed bed or expanded bed operations. Preferred catalysts for use in fixed bed processes are those having an average particle size of from about 0.8 millimeter to about 3.2 millimeters effective diameter. Pellets, spheres, and/or extrudate are contemplated for fixed bed use. In addition, more complicated shapes, such as clover leaf, cross-shaped or C-shaped catalyst are contemplated. Preferred catalysts for expanded bed use are spheres or extrudates having diameters of from about 0.8 millimeter to about 1.6 millimeters.

Hydrocarbon feeds to be hydrotreated according to this invention are those containing sufficiently high levels of nitrogen, sulfur, metals or high boiling components as to hinder direct use in more conventional refining operations, such as catalytic cracking or hydrocracking. Examples of feeds that can be treated according to this invention include petroleum hydrocarbon streams, hydrocarbon streams derived from coal, hydrocarbon streams derived from tar sands and hydrocarbon streams derived from oil shale. Typical examples of petroleum hydrocarbon streams include petroleum distillates, virgin gas oils, vacuum gas oils, coker gas oils and atmospheric and vacuum resids. Hydrocarbon streams derived from oil shale, such as whole shale oil or a fraction thereof, are also particularly well suited. Preferred feeds are those containing at least about 0.1 wt. % nitrogen or resids containing high concentrations of sulfur and/or metals.

The conditions employed in operation of the process of the present invention will vary with the particular hydrocarbon stream being treated, with mild conditions being employed in the hydrotreating of light distillates, such as naphtha and kerosene, typically 232° C. to 316° C. and about 690 kPa to 4,137 kPa of hydrogen partial pressure. Heavier materials can be treated under conditions of about 3.45 MPa to 20.76 MPa of hydrogen partial pressure, an average catalyst bed temperature within the range of about 315° C. to about 443° C., with an LHSV (liquid hourly space velocity) within the range of about 0.1 to about 5 volumes of hydrocarbon per hour per volume of catalyst, and a hydrogen recycle rate or hydrogen addition rate within the range of about 89 $m^3/m^3$ to 3,560 $m^3/m^3$.

For the removal of nitrogen from feeds containing at least 0.1 wt. % nitrogen, hydrodenitrogenation conditions are preferred. Best results in removing nitrogen from whole shale oil are obtained under hydrodenitrogenation conditions comprising about 8.3 MPa to about 17.3 MPa total pressure, average catalyst bed temperatures within the range of about 388° C. to about 427° C., an LHSV of about 0.3 to about 2 volumes of hydrocarbon per hour per volume of catalyst, and a hydrogen recycle rate or hydrogen addition rate within the range of about 178 $m^3/m^3$ to about 1780 $m^3/m^3$.

For the removal of metals from feeds containing at least about 150 ppm of total metals, hydrodemetallation conditions are preferred and include a temperature of from about 371° C. to about 454° C., a pressure of from about 7 MPa to about 21 MPa, a hydrogen addition rate of from about 178 $m^3/m^3$ to about 1780 $m^3/m^3$ and a space velocity of from about 0.1 to about 5 volumes of feed per volume of catalyst per hour.

For the removal of sulfur from feeds containing at least about 0.1 wt. % sulfur, hydrodesulfurization conditions are preferred. Best results in removing sulfur from a vacuum or atmospheric resid are hydrodesulfurization conditions comprising about 12.4 MPa to 20.7 MPa total pressure, about 399° C. to 427° C. average catalyst bed temperature, about 178 $m^3/m^3$ to 1780 $m^3/m^3$ hydrogen rate and about 0.1 to about 5 volumes feed per volume catalyst per hour LHSV.

It is of course understood that, in this context, "resid" includes a resid which has been subjected to a prior treatment such as a hydrodemetallation treatment. For example, when the feed comprises a metal-containing heavy hydrocarbon stream, it is known to be highly advantageous to employ a two-stage hydrotreatment of the stream wherein a demetallation catalyst is employed in the first stage and provides demetallated effluent which is contacted in the second stage with a desulfurization catalyst. In a preferred embodiment of this invention, a catalyst of the present invention having the aforesaid preferred pore volume, surface area, average pore diameter and pore size distribution is employed as the desulfurization catalyst in the aforesaid two-stage hydrotreatment process.

Thus, such preferred embodiment of the present invention comprises a two-stage process for the hydrodemetallation and hydrodesulfurization of a hydrocarbon feedstock containing asphaltenes and a substantial amount of metals. Such feedstock generally contains asphaltenes, metals, nitrogen compounds and sulfur compounds. It is to be understood that the feedstocks that are to be treated by the preferred two-stage hydrotreatment process of the present invention contain from a small amount of nickel and vanadium, for example, about 40 ppm up to more than 1,000 ppm of the combined total amount of nickel and vanadium, up to about 25 wt. % of asphaltenes. This preferred two-stage hydrotreatment process is particularly useful in treating feedstock with a substantial amount of metals, for example, one containing 150 ppm or more of nickel and vanadium, and with a sulfur content in the range of about 1 wt. % to about 10 wt. %. Typical feedstocks that can be treated satisfactorily by the preferred two-stage hydrotreatment process of the present invention also contain a substantial amount of components that boil appreciably above 538° C. Examples of typical feedstocks are crude oils, topped crude oils, petroleum hydrocarbon resids, both atmospheric and vacuum resids, oils obtained from tar sands and resids derived from tar sands oil, hydrocarbon streams derived from coal, and blends of any of the aforesaid resids with lower boiling materials. Such hydrocarbon streams contain organometallic contaminants which create deleterious effects in various refining processes that employ catalysts in the conversion of the particular hydrocarbon stream being treated. The metallic contaminants that are found in such feedstocks include, but are not limited to, iron, vanadium and nickel.

In this preferred embodiment, the first-stage catalyst and the second-stage catalyst can be employed in a single reactor as a dual bed or the two catalysts can be employed in separate, sequential reactors, and various combinations of these two basic reactor schemes can be employed to achieve flexibility of operation and product upgrade. In any event, the feed is contacted with the demetallation catalyst first and then with the desulfurization catalyst. In commercial operation, either of the basic reactor schemes described can comprise multiple parallel beds of the catalyst. The direction of flow of the feedstock can be upward or downward. In any reactor scheme used in the process of this invention, the volumetric ratio of first-stage catalyst to second-stage catalyst can be within a broad range, preferably within about 5:1 to about 1:10 and more preferably within about 2:1 to about 1:5.

The first-stage, demetallation catalyst in the method of the present invention comprises a hydrogenation component and a large-pore, high surface area inorganic oxide support. Suitable demetallation catalysts comprise catalytic amounts of a hydrogenation component typically including a Group VIB metal, a Group VIII metal or a mixture of Group VIB and Group VIII metals deposed on a relatively large-pore, high surface area porous inorganic oxide support, suitably alumina, silica, magnesia, zirconia and similar materials. This first-stage catalyst has a surface area of about 100 $m^2/gm$ to about 400 $m^2/gm$, an average pore diameter of about 125 Å to about 350 Å, and a pore volume of about 0.7 cc/gm to about 1.7 cc/gm. Suitably, the composition of the demetallation catalyst comprises from about 1 wt. % to about 30 wt. % of the Group VIB metal, calculated as the oxide, and/or from about 0.5 to about 12 wt. % of the Group VIII metal, calculated as the oxide, based upon the total weight of the composition. The Group VIB and Group VIII classifications of the Periodic Table of Elements can be found on page 628 of *Webster's Seventh New Collegiate Dictionary*, G. & C. Merriam Company, Springfield, Mass., U.S.A. (1965). While calculated as the oxide, the hydrogenation metal components of the catalyst can be present in the elemental form or as the sulfide or oxide thereof.

Commercially available catalysts that are suitable for use as the first-stage, demetallation catalyst include American Cyanamid's 1442B and Amocat 1A®, both bimodal. In addition, the embodiment of the catalyst of the present invention which is described hereinabove as employed in a hydrotreatment operation in which demetallation is a major concern, can also be employed as the first-stage demetallation catalyst.

The first-stage catalyst used in the process of the present invention can be prepared by the typical commercial method of impregnating a large-pore, high surface area inorganic oxide support. Appropriate commercially available alumina, preferably calcined at about 426° C. to 872° C., for about 0.5 to about 10 hours, can be impregnated to provide a suitable lead catalyst having an average pore diameter of about 125 Å to about 350 Å, a surface area ranging from about 100 $m^2/gm$ to about 400 $m^2/gm$, and a pore volume within the range of about 0.7 cc/gm to about 1.7 cc/gm. The alumina can be impregnated with a solution, usually aqueous, containing a heat-decomposable compound of the metal(s) to be placed on the catalyst, and then drying and calcining the impregnated material. The drying can be conducted in air at a temperature of about 65° C. to about 204° C. for a period of 1 to 16 hours. Typically, the calcination can be carried out at a temperature of about 426° C. to about 648° C. for a period of from 0.5 to 8 hours.

The finished second-stage catalyst that is employed in the process of the present invention has a pore volume within the range of about 0.4 cc/gm to about 0.9 cc/gm, a surface area within the range of about 130 $m^2/gm$ to about 300 $m^2/gm$, and an average pore diameter within the range of about 90 Å to about 160 Å. Preferably, the catalyst possesses a pore volume within the range of about 0.5 cc/gm to about 0.7 cc/gm, a surface area within the range of about 140 $m^2/gm$ to about 250 $m^2/gm$, and an average pore diameter within the range of about 110 Å to about 140 Å.

In order to maximize the desulfurization activity, the second-stage catalyst should have less than 40% of its pore volume in pores having diameters within the range of about 50 Å to about 80 Å, about 45% to about 90% of its pore volume in pores having diameters within the range of about 80 Å to about 130 Å, and less than about 15% of its pore volume in pores having diameters that are larger than 130 Å. More preferably, the second-stage catalyst has a pore volume distribution summarized as follows:

| Pore Diameter, Å | % of Pore Volume |
|---|---|
| 50–80 | <40 |
| 80–100 | 15–65 |
| 100–130 | 10–50 |
| >130 | <15 |

Most preferably, the second-stage catalyst has a pore volume distribution summarized as follows:

| Pore Diameter, Å | % of Pore Volume |
|---|---|
| 50–80 | <40 |
| 80–100 | 25–65 |
| 100–130 | 10–50 |

-continued

| Pore Diameter, Å | % of Pore Volume |
|---|---|
| >130 | <5 |

The catalyst pores having diameters 80 Å to 130 Å preferably should contain from about 90 $m^2/gm$ to 180 $m^2/gm$, and more preferably 120 $m^2/gm$ to 180 $m^2/gm$, of surface area in order to attain maximum activity.

In both the first reaction zone and the second reaction zone, operating conditions for the hydrotreatment of heavy hydrocarbon streams, such as petroleum hydrocarbon resids and the like, comprise a pressure within the range of about 7 MPa to about 21 MPa, an average catalyst bed temperature within the range of about 371° C. to about 454° C., a LHSV within the range of about 0.1 volume of hydrocarbon per hour per volume of catalyst to about 5 volumes of hydrocarbon per hour per volume of catalyst, and a hydrogen recycle rate or hydrogen addition rate within the range of about 178 $m^3/m^3$ to about 2,671 $m^3/m^3$. Preferably, the operating conditions comprise a total pressure within the range of about 10 MPa to about 18 MPa; an average catalyst bed temperature within the range of about 387° C. to about 437° C.; a LHSV within the range of about 0.1 to about 1.0; and a hydrogen recycle rate or hydrogen addition rate within the range of about 356 $m^3/m^3$ to about 1,780 $m^3/m^3$.

The following examples are intended to illustrate the present invention without limiting the scope thereof.

EXAMPLE I

A control catalyst, identified hereinafter as Catalyst I and containing 15.0 wt. % $MoO_3$ supported on gamma-alumina, was prepared as follows.

300 gm gamma-alumina (obtained from Continental Oil Company and identified as Catapal) were calcined in an oven at 500° C. for 3 hours. The calcined product, having BET surface area of 230 $m^2/gm$, pore volume of 0.65 cc/gm as determined by nitrogen adsorption using a Digisorb 2500 instrument and average pore diameter of 113 Å calculated as $(4V \times 10^4)/A$ was placed in a desiccator until used.

To 85.00 gm of the calcined gamma-alumina in a porcelain dish were added 18.40 gm ammonium heptamolybdate $(NH_4)_6Mo_7O_{24}.4H_2O$ dissolved in 33 ml water and 15 ml concentrated ammonium hydroxide, the latter having been used to completely dissolve the ammonium heptamolybdate. The amount of solution employed was sufficient to fill the pores of the alumina support. The impregnated support was allowed to stand at ambient temperature (about 25° C.) for one hour and then the result was dried for one hour at 250° F. (121° C.) in an oven and calcined in air for one hour at 1,000° F. (538° C.). The resulting catalyst was ground and screened to 14/20 mesh and then tested for activity according to Example IV.

EXAMPLE II

A catalyst according to the invention, identified hereinafter as Catalyst II and containing 15.0 wt. % $MoO_3$ and 1.3 wt. % P, was prepared as follows.

Following the procedure of Example I, 18.40 gm ammonium heptamolybdate and 4.83 gm 85% phosphoric acid dissolved in 46 ml water were added to 82.02 gm of the calcined gamma-alumina from Example I. After standing for one hour at ambient temperature, the impregnated support was dried, calcined and crushed and screened as in Example I. The resulting catalyst was tested for activity according to Example IV.

EXAMPLE III

A second control catalyst, identified hereinafter as Catalyst III and again containing 15.0 wt. % $MoO_3$, was prepared by a two-step impregnation as follows.

To 85.00 gm of the calcined gamma-alumina from Example I were added 9.2 gm ammonium heptamolybdate dissolved in 52 ml water. After standing for an hour at ambient temperature, the impregnated support was dried and calcined as in Example I. To the result were added 9.20 gm ammonium heptamolybdate dissolved in 52 ml $H_2O$ and the result again was allowed to stand, and then dried and calcined as in Example I. The calcined catalyst was crushed and screened to 14/20 mesh as in Example I and tested according to Example IV.

EXAMPLE IV

The catalysts from Examples I–III were tested in a 81 cm long, 0.95 cm inner diameter, vertical reactor equipped with automatic controls for monitoring temperature, feed rate and hydrogen partial pressure. In each test, 15.00 cc catalyst were loaded into the reactor and sulfided by passing 8 vol. % $H_2S$ in hydrogen over the catalyst at about 0.03 $m^3$/hr and total pressure of about 2 MPa at 148° C. for one hour, followed by 204° C. for one hour, and then 375° C. for one hour. On completion of sulfiding, temperature was increased to 404° C., the feed was introduced via a positive displacement Ruska pump at a liquid hourly space velocity (LHSV) of 0.64 volume feed per volume catalyst per hour, and the reactor was charged with hydrogen to 12 MPa. Each test was conducted for 6–7 days with daily sampling of liquid product recovered using a high pressure separator.

The feed used in all tests was a whole shale oil generated in situ from oil shale and having properties as shown in Table 1. Also shown in the table are properties of samples of product taken on the last day of each test.

TABLE 1

| Property | Feed | Test Number 1 | 2 | 3 |
|---|---|---|---|---|
| Catalyst | NA(1) | I | II | III |
| Length of test (days) | NA | 7 | 7 | 6(2) |
| Carbon (wt. %) | 83.54 | 86.13 | 86.16 | ND |
| Hydrogen (wt. %) | 11.85 | 13.73 | 13.88 | ND |
| Sulfur (wt. %) | 1.75 | 0.007 | 0.017 | ND |
| Oxygen (wt. %) | 1.34 | ND | ND | ND |
| Total nitrogen (wt. %) | 1.72 | 0.12 | 0.031 | 0.24(3) |
| Basic nitrogen (wt. %) | 0.83 | 0.09 | 0.024 | 0.11 |
| Liquid product (gm) | NA | 166 | 157 | 70.1 |
| API gravity (°) | 23.1 | 37.7 | 38.7 | 37.7 |
| Pour point (°C.) | +21 | +26 | +21 | ND |
| Simulated distillation (wt. %) Temp. (°C.) | | | | |
| <182 | 1.0 | 6.5 | 8.0 | ND |
| 182–343 | 42.0 | 61.5 | 56.0 | ND |
| 343–538 | 51.5 | 32.0 | 35.0 | ND |
| >538 | 5.5 | 0 | 1.0 | ND |
| $H_2$ consumption ($m^3/m^3$) | NA | 255 | 257 | ND |
| $C_1$—$C_4$ yield (wt. %) | NA | 3.5 | 3.3 | ND |

(1)In this and all subsequent tables, "not applicable" is abbreviated "NA" and "not determined" is abbreviated "ND."
(2)On day 6 of this test the feed pump was off for about 20 hours. Hydrogen flow was maintained during this period.
(3)In view of the poor nitrogen removal exhibited by Catalyst III, most other product properties were not determined.

From the table it can be seen that Catalyst II according to the present invention exhibited superior hydrodenitrogenation activity as measured by both total and basic product nitrogen. Based on first order hydrodenitrogenation kinetics observed for total nitrogen removal, Catalyst II had a hydrodenitrogenation activity about 1.5 times that of control Catalyst I and about 1.7 times that of control Catalyst III. It also can be seen from Table 1 that Catalyst II gave about 95% removal of product sulfur indicating high hydrodesulfurization activity.

EXAMPLE V

A series of catalysts was prepared according to the general procedure of Examples I–III and tested as in Example IV. Composition of the catalysts and hydrodenitrogenation activity based upon both total and basic nitrogen relative to control Catalyst I (see Example I) are reported in Table 2. For completeness, relative activities of Catalyst II and control Catalyst III also are included in the table. Unless otherwise indicated, $MoO_3$ content of catalysts was 15 wt. % and phosphorus content, calculated as the element, was 1.3 wt. %.

TABLE 2

| Catalyst Number | Composition | Relative Activity Total N | Basic N |
|---|---|---|---|
| I | $MoO_3/Al_2O_3$ | 1 | 1 |
| III | $MoO_3/Al_2O_3$ | 0.89 | 0.84 |
| II | $MoO_3$—$P/Al_2O_3$ | 1.49 | 1.62 |
| IV | $MoO_3/Al_2O_3-P$(1) | 0.83 | 0.71 |
| V | $MoO_3-P/Al_2O_3-P$(1) | 0.72 | 0.61 |
| VI | $MoO_3-P/Al_2O_3$(2) | 1.34 | 1.41 |
| VII | $MoO_3-P/Al_2O_3$(3) | 1.71 | 1.88 |

(1)The support used in preparation of Catalysts IV and V was a large-pore alumina containing about 5.0 wt. % phosphorus, calculated as the element.
(2)In preparation of Catalyst VI, an alumina support as in Example 1 was impregnated with 2.4 gm 85 wt. % phosphoric acid in 26 ml water, dried and calcined, impregnated with molybdenum heptamolybdate and dried and calcined.
(3)Catalyst VII contained 18 wt. % $MoO_3$.

As can be seen from Table 2, Catalysts II, VI and VII according to the invention were significantly more active for hydrodenitrogenation than any of the other catalysts, with Catalysts II and VII, in which molybdenum and phosphorus component precursors were simultaneously impregnated, being superior to Catalyst VI, in which phosphorus and molybdenum component precursors were sequentially impregnated. Direct comparison of results with Catalysts IV and V to results with the other catalysts is difficult because the pore structure of the alumina- and phosphorus oxide-containing support of the former was significantly different from that of the small-pore alumina used for the other catalysts. However, comparison of results with Catalyst IV to those with Catalyst V indicates that the presence of phosphorus in the support was detrimental to attempted promotion of hydrogenating metal with phosphorus component.

EXAMPLE VI 78.6 grams of a gamma-alumina extrudate (obtained from American Cyanamid and identified as SN 4695) having a 0.079 centimeter average diameter was calcined in an oven at 500° C. for 3 hours. The calcined product had a BET surface area of 204 $m^2$/gm, a pore volume of 0.77 cc/gm, both as determined by nitrogen desorption, an average pore diameter of 151 Å, and the following distribution of the total pore volume: 22.6% in pores having diameters of 50Å to 80Å, 73.8% in pores having diameters of 80Å to 130Å, 42.7% in pores having diameters 80Å to 100Å, 31.2% in pores having diameters of 100Å to 130Å, and 2.1% in pores having diameters greater than 130Å. The calcined alumina has the following surface area distribution: 58.9 $m^2$/gm in pores having diameters of 50Å to 80Å, 137.4 $m^2$/gm in pores having diameters of 80Å to 130Å, 84.9 $m^2$/gm in pores having 80Å to 100Å, 525.5 $m^2$/gm in pores having diameters of 100Å to 130Å, and 2.2 $m^2$/gm in pores having diameters greater than 130Å.

78.6 grams of this calcined gamma alumina was combined with a solution containing 22.08 grams of ammonium heptamolybdate $(NH_4)_6 Mo_7O_{24}.6H_2O$ and 6.12 grams of 85% phosphoric acid in 50 milliliters of water. The volume of solution employed was sufficient to fill the pores of the alumina. The resulting mixture was allowed to stand at ambient temperature (about 25° C.) for one hour, then was dried for one hour at 120° C. in an oven, and thereafter was calcined in air for one hour at 540° C.

The resulting product is designated Catalyst A, and its metals content, pore volume, pore volume distribution, surface area, surface area distribution and average pore diameter are presented in Table 3.

TABLE 3

| Catalyst | A | B | C | D |
|---|---|---|---|---|
| Metals concentration (wt %) | | | | |
| Mo, as $MoO_3$ | 18 | 10.3 | 3.5–4.6 | 16.3 |
| Co, as CoO | — | — | — | 3.4 |
| P, as P | 1.6 | — | — | — |
| Total Pore volume (cc/gm) | 0.5424 | 0.6215 | 1.15–1.50 | 0.6528 |
| % of Pore volume in pores having diameters (Å) of | | | | |
| 50–80 | 21.4 | 26.1 | | 14.0 |
| 80–130 | 75.0 | 61.1 | | 50.0 |
| 80–100 | 44.6 | 35.3 | | 20.9 |
| 100–130 | 31.4 | 25.8 | | 29.1 |
| >130 | 2.1 | 9.2 | | 31.6 |
| Total Surface area ($m^2$/gm) | 148 | 184 | 150–180 | 172 |
| Surface area ($m^2$/gm) in pores having diameters (Å) of | | | | |
| 50–80 | 40.5 | 60.7 | — | 36.0 |
| 80–130 | 104.2 | 100.3 | — | 85.3 |
| 80–100 | 65.2 | 62.6 | — | 40.4 |
| 100–130 | 39.0 | 37.7 | — | 44.9 |
| >130 | 1.6 | 0.55 | — | 27.7 |
| Average pore diameter (Å) | 94 | 92 | >200 | 110 |

EXAMPLES VII–XI

Various combinations of Catalysts A, B, C and D were employed in a two-reactor system for the demetallation and desulfurization of a resid feed. Each of Catalysts B, C and D was a metal-impregnated gamma-alumina extrudate obtained from American Cyanamid and having a 0.079 centimeter average diameter. The metals content, pore volume, pore volume distribution, surface area, surface area distribution and average pore diameter of each of Catalysts B, C and D are also presented in Table 3. Catalyst D is marketed as Amocat 1A.

Each reactor was 81 centimeters long and had an inside diameter of 0.95 centimeter. In operation, the feed flowed upwardly through the first or upstream reactor and the effluent from the first reactor then flowed upwardly through the second or downstream reactor. In Examples VII and VIII, the upstream reactor was loaded with a uniform mixture of 10 cubic centimeters of Catalyst C and 10 cubic centimeters of 10/14 mesh porous alpha-alumina diluent, and the downstream reactor was loaded with a uniform mixture of 20 cubic centimeters of Catalyst B and 20 cubic centimeters of 10/14 mesh porous alpha-alumina diluent.

In Example 9, the upstream reactor was loaded with a uniform mixture of 10 cubic centimeters of Catalyst C and 10 cubic centimeters of 10/14 mesh alpha-alumina diluent, and the downstream reactor was loaded with a uniform mixture of 20 cubic centimeters of Catalyst A and 20 cubic centimeters of 10/14 mesh, alpha-alumina diluent. In Example 10, the upstream reactor was loaded with a uniform mixture of 10 cubic centimeters of Catalyst D and 20 cubic centimeters of 10/14 mesh vermiculite diluent, and the downstream reactor was loaded with a uniform mixture of 20 cubic centimeters of Catalyst A and 20 cubic centimeters of 10/14 mesh vermiculite diluent. In Example 11, the upstream reactor was loaded with a uniform mixture of 10 cubic centimeters of Catalyst D and 20 cubic centimeters of 10/14 mesh alpha-alumina diluent, and the downstream reactor was loaded with a uniform mixture of 20 cubic centimeters of Catalyst A and 20 cubic centimeters of 10/14 mesh alpha-alumina diluent.

The feed used in Examples VII–XI was a vacuum resid, an atmospheric resid or a blend of these resids. The feed characteristics are presented in Table 4.

TABLE 4

| Feed Composition (Wt. %) | Feed 1 | Feed 2 |
|---|---|---|
| Nickel (p.p.m.) | 52 | 104 |
| Vanadium (p.p.m.) | 228 | 462 |
| Sulfur | 3.91 | 3.70 |
| Nitrogen | 0.478 | 0.62 |
| Carbon | 84.72 | 84.66 |
| Hydrogen | 10.35 | 10.38 |
| <538° C. | 8.6 | 43.7 |
| Ramscarbon | 21.0 | 13.42 |
| Asphaltenes | 12.6 | 7.5 |
| Toluene insolubles | 1.06 | 0.14 |
| API Gravity (°) | 6.6 | 9.4 |

To start a run, both upstream and downstream reactors were filled with gas oil and pressured to 13.8 MPa with hydrogen. The temperature of each reactor was then raised to 149° C. for at least one hour and then was raised to the desired reaction temperature. Using a positive displacement Ruska pump, resid feed was then introduced to the upstream reactor, from which the effluent then passed into the downstream reactor. The feed rate in each reactor was from about 0.2 to about 1.0 volume per hour per volume of catalyst, in terms of space velocity. Each of Examples VII–XI was conducted for 14 to 61 days, with daily sampling and analysis of the liquid product recovered using a high pressure separator.

The conditions employed in Examples VII–XI are shown in Table 5. The reaction temperature, space velocity or identity of the feed employed in Examples IX–XI were varied during the course of the run. Consequently, in Table 5, the reaction temperature, space velocity and identity of the feed are listed for each stage of the runs where one of them is changed. The feed rate presented in Table 5 is the overall space velocity based on combined volume of catalysts in the upstream and downstream reactors. The higher metals content of Feed 2 was employed, and generally at higher space velocities, to accelerate the substantial deposition of metal contaminants on the catalyst, under which condition, prior art catalysts are known to deactivate.

The results obtained for the liquid product sampled at one day during the run in each of Examples VIII and XI and the results obtained for the liquid products sampled at two days during the run in each of Examples VII, IX, and X are presented in Table 6. The API gravities, combined nickel and vanadium contents and solids contents of all of the liquid products sampled during Example IX are presented in FIGS. 1–3, respectively.

TABLE 5

| Example No. | VII | VIII | IX | X | XI |
|---|---|---|---|---|---|
| Days | 1–23 | 1–14 | 1–9 | 1–7 | 1–16 |
| Feed | 1 | 1 | 1 | 1 | 2 |
| Feed Rate (v/v/hr) | 0.2 | 0.2 | 0.2 | 0.2 | 1.0 |
| Temperature (°C.) | 416 | 405 | 405 | 416 | 416 |
| Hydrogen Addition Rate ($m^3/m^3$) | 1600 | 1600 | 1600 | 1600 | 900 |
| Days | | | 10–34 | 8–20 | 17–31 |
| Feed | | | 1 + 2 | 2 | 1 |
| Feed Rate (v/v/hr) | | | 0.2 | 1.0 | 0.2 |
| Temperature (°C.) | | | 416 | 416 | 416 |
| Hydrogen Addition Rate ($m^3/m^3$) | | | 1600 | 900 | 1600 |
| Days | | | 35–56 | 21–28 | |
| Feed | | | 1 | 1 | |
| Feed Rate (v/v/hr) | | | 0.2 | 0.2 | |
| Temperature (°C.) | | | 416 | 416 | |
| Hydrogen Addition Rate ($m^3/m^3$) | | | 1600 | 1600 | |
| Days | | | 57–61 | | |
| Feed | | | 1 | | |
| Feed Rate (v/v/hr) | | | 0.2 | | |
| Temperature (°C.) | | | 418 | | |
| Hydrogen Addition Rate ($m^3/m^3$) | | | 1600 | | |

TABLE 6

| | Example 7 | | Example 8 | | Example 9 |
|---|---|---|---|---|---|
| Day | 15 | 23 | 8 | 9 | 52 |
| Metal Content of Catalyst (Wt. %) | 3.0 | 4.5 | 1.24 | 2.1 | 17.8 |
| $H_2$ Consumption ($m^3/m^3$) | 267 | 255 | 187 | 225 | 209 |
| Liquid Product Properties | | | | | |
| Content (Wt. %) | | | | | |
| Nickel (ppm) | 14 | 12 | 3 | 2 | 8 |
| Vanadium (ppm) | 3 | 6 | <2 | 2 | 4 |
| Sulfur | 0.43 | 0.47 | 0.80 | 0.24 | 0.64 |
| Nitrogen | 0.25 | 0.22 | 0.32 | 0.29 | 0.25 |
| Carbon | 85.95 | 86.99 | 87.11 | 87.15 | 86.38 |
| Hydrogen | 11.90 | 11.89 | 11.63 | 11.98 | 11.73 |
| <538° C. | 83.0[a] | 75.5[b] | 68.0[a] | 74.5[b] | 65.3[b] |
| Asphaltenes | 1.2 | 1.54 | 1.5 | 2.3 | 0.7 |
| Ramscarbon | 4.10 | 4.84 | 6.77 | 7.25 | 5.72 |
| $C_1$—$C_4$ | 4.77 | 5.02 | 2.09 | 1.62 | 2.26 |
| Toluene Insolubles | 0.62 | 0.49 | ND | ND | 0.86 |
| API Gravity (°) | 25.1 | 24.0 | 20.8 | 19.5 | 22.8 |

| | Example 10 | | Example 11 |
|---|---|---|---|
| Day | 6 | 25 | 23 |
| Metal Content of Catalyst (Wt. %) | 1.1 | 20.2 | 22 |

TABLE 6-continued

| | | | |
|---|---|---|---|
| $H_2$ Consumption ($m^3/m^3$) | 242 | ND | ND |
| Liquid Product Properties | | | |
| Content (Wt. %) | | | |
| Nickel (ppm) | <2 | 16 | 8 |
| Vanadium (ppm) | <2 | 37 | 9 |
| Sulfur | 0.22 | 0.53 | 0.49 |
| Nitrogen | 0.15 | ND | 0.18 |
| Carbon | 87.10 | ND | ND |
| Hydrogen | 12.06 | ND | ND |
| <538° C. | 89.4[b] | 88.0[b] | |
| Asphaltenes | 0.26 | ND | ND |
| Ramscarbon | 2.07 | 2.47 | 3.72 |
| $C_1$—$C_4$ | 2.16 | ND | ND |
| Toluene Insolubles | 0.23 | 0.53 | 0.98 |
| API Gravity (°) | 27.6 | 27.0 | 25.3[c] |

Footnotes
[a]Determined by gas chromatographic simulated distillation
[b]Determined by distillation
[c]Value for the 22nd day The results in Table 6 and the plots in FIGS. 1–3 illustrate that the activity of the catalyst of this invention in the desulfurization stage is maintained even after a very substantial buildup of metals on the catalyst. With a conventional catalyst employed in the desulfurization stage in Example VII, the reactor system plugged at the end of the 23rd day of the run as a result of excessive solids formation. By contrast, when a catalyst of the present invention was employed in the desulfurization stage in Example IX, the level of solids in the liquid product was only up to about 1 wt. % even when the buildup of metals on the catalyst was in excess of 20 wt. % of the catalyst, and the reactor system was operable throughout the 61 day run. Furthermore, the conversion to product boiling below 538° C. was at substantially the same level in Example IX at the 9th day of the run and at a reaction temperature of only 405° C. as in Example VII at the 23rd day of the run and at the higher reaction temperature of 416° C.

From the above description it is apparent that the objects of the present invention have been achieved. While only certain embodiments have been set forth, alternative embodiments and various modifications will be apparent from the above description to those skilled in the art. These and other alternatives are considered equivalents and are within the spirit and scope of the present invention.

Having described the invention, what is claimed is:

1. A process for hydrotreating a feedstock consisting essentially of a whole shale oil wherein the feedstock contains at least one component selected from the group consisting of sulfur, nitrogen and metals, wherein said process comprises contacting the feedstock with hydrogen under hydrotreating conditions and in the presence of a catalyst comprising a hydrogenating component consisting essentially of (1) at least one Group VIB metal component and (2) a phosphorus component, deposed on the surface of a support component comprising a porous refractory inorganic oxide and free of a zeolite component.

2. The process of claim 1 wherein the catalyst has a BET surface area of at least 100 $m^2$/gm, a pore volume within the range of from about 0.3 cc/gm to about 1.7 cc/gm, an average pore diameter within the range of from about 70 Å to about 350 Å, the Group VIB metal component at a concentration within the range of from about 1 wt. % to about 30 wt. %, calculated as the metal oxide and based on the weight of the catalyst, and the phosphorus component at a concentration within the range of from about 0.1 wt. % to about 5 wt. %, calculated as elemental phosphorus and based on the weight of the catalyst.

3. The process of claim 1 wherein the porous refractory inorganic oxide comprises alumina.

4. The process of claim 1 wherein the Group VIB metal is molybdenum alone or in combination with at least one of chromium or tungsten.

5. The process of claim 1 wherein the feedstock contains at least about 0.1 wt. % of sulfur and the hydrotreating conditions comprise hydrodesulfurization conditions, which comprise a temperature of from about 399° C. to about 427° C., a pressure of from about 12.4 MPa to about 20.7 MPa, a hydrogen addition rate of from about 178 $m^3/m^3$ to about 1780 $m^3/m^3$ and a space velocity of from about 0.1 to about 5 volumes of feed per volume of catalyst per hour, wherein the catalyst has a pore volume within the range of about 0.4 cc/gm to about 0.9 cc/gm, a BET surface area within the range of about 130 $m^2/gm$ to about 300 $m^2/gm$, an average pore diameter within the range of about 90Å to about 160Å, and a pore volume distribution such that less than about 40% of its total pore volume is in pores having diameters within the range of about 50Å to about 80Å, about 45% to about 90% of its total pore volume is in pores having diameters within the range of about 80Å to about 130Å, and less than about 15% of its total pore volume is in pores having diameters greater than 130Å and wherein the catalyst comprises from about 8 wt. % to about 22 wt. % of the Group VIB metal component, calculated as the metal oxide and based on the weight of the catalyst, and from about 0.5 wt. % to about 3 wt. % of the phosphorus component, calculated as elemental phosphorus and based on the weight of the catalyst.

6. The process of claim 1 wherein the feedstock contains at least about 0.1 wt. % total nitrogen and the hydrotreating conditions comprise hydrodenitrogenation conditions, which comprise a temperature of from about 388° C. to about 427° C., a pressure of from about 8.3 MPa to about 17.3 MPa, a hydrogen addition rate of from about 178 $m^3/m^3$ to about 1780 $m^3/m^3$ and a space velocity of from about 0.3 to about 2 volumes of feed per volume of catalyst per hour, wherein the catalyst has a pore volume within the range of from about 0.3 cc/gm to about 1.2 cc/gm, a BET surface area within the range of from about 100 $m^2/gm$ to about 350 $m^2/gm$, and an average pore diameter within the range of from about 70 Å to about 120 Å, and wherein the catalyst comprises from about 15 wt. % to about 22 wt. % of the Group VIB metal component, calculated as the metal oxide and based on the weight of the catalyst, and from about 0.5 wt. % to about 3 wt. % of the phosphorus component, calculated as elemental phosphorus and based on the weight of the catalyst.

7. A process for the hydrodemetallation and hydrodesulfurization of a hydrocarbon feedstock containing asphaltenes and a substantial amount of metals, said feedstock consisting essentially of a whole shale oil which process comprises:

(a) contacting said feedstock in a first reaction zone with hydrogen and a first-stage catalyst comprising (1) a hydrogenation metal component comprising at least one member selected from the group consisting of Group VIB metals and Group VIII metals, and (2) a porous inorganic oxide support, said hydrogenation metal being in at least one form selected from the group consisting of the elemental form, the oxide, and the sulfide, and said catalyst having a surface area of about 100 $m^2/gm$ to about 400 $m^2/gm$, a pore volume of about 0.7 cc/gm to about 1.7 cc/gm, and an average pore diameter of about 125Å to about 350Å; and (b) contacting the effluent from the first reaction zone in a second reaction zone with a second-stage catalyst comprising a hydrogenating component consisting essentially of (1) a metal component in which the metal is selected from Group VIB and (2) a phosphorus component, deposed on the surface of a support comprising a porous refractory inorganic zeolite component, and having a pore volume within the range of about 0.4 cc/gm to about 0.9 cc/gm, a surface area within the range of about 130 $m^2/gm$ to about 300 $m^2/gm$, an average pore diameter within the range of about 90 Å to about 160 Å, and a pore volume distribution such that less than about 40% of its total pores volume is in pores having diameters within the range of about 50 Å to about 80 Å, about 45% to about 90% of its total pore volume is in pores having diameters within the range of about 80 Å to about 130 Å, and less than about 15% of its total pore volume is in pores having diameters greater than 130 Å.

8. The process of claim 7 wherein the hydrogenation metal component of the first-stage catalyst additionally comprises a phosphorus component.

9. The process of claim 8 wherein the hydrogenation component of the first-stage catalyst consists essentially of the Group VIB metal component at a concentration of from about 1 wt. % to about 20 wt. %, calculated as the metal oxide and based on the weight of the catalyst, the phosphorus component at a concentration of from about 0.5 wt. % to about 3 wt. %, calculated as elemental phosphorus and based on the weight of the catalyst, and the Group VIII metal component at a concentration of up to about 15 wt. %, calculated as the metal oxide and based on the weight of the catalyst.

10. The process of claim 9 wherein the Group VIII metal component in the first-stage catalyst is at a concentration in the catalyst of from about 0.5 wt. % to about 3 wt. %, calculated as the metal oxide and based on the weight of the catalyst.

11. The process of claim 7 wherein the porous refractory inorganic oxide in the second-stage catalyst comprises alumina.

12. The process of claim 7 wherein the Group VIB metal in the second-stage catalyst is molybdenum alone or in combination with at least one of chromium or tungsten.

13. The process of claim 7 wherein the volumetric ratio of the first-stage catalyst to the second-stage catalyst is within the range of about 5:1 to about 1:10.

14. The process of claim 1 wherein the support component is substantially free of a phosphorus component other than the phosphorus component deposited thereon.

15. The process of claim 7 wherein the support of the second-stage catalyst is substantially free of a phosphorus component other than the phosphorus component deposited thereon.

* * * * *